US007984677B2

(12) United States Patent
Meltser et al.

(10) Patent No.: US 7,984,677 B2
(45) **Date of Patent: *Jul. 26, 2011**

(54) ALTITUDE COMPENSATION SYSTEM FOR NATURALLY ASPIRATED RAILROAD LOCOMOTIVE

(75) Inventors: Mikhail Meltser, Buffalo Grove, IL (US); Bryan Thomas Jett, Erie, PA (US); Neil Xavier Blythe, North East, PA (US); Ronald Bauerle, Erie, PA (US); Ajith Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 630 days.

This patent is subject to a terminal disclaimer.

(21) Appl. No.: 11/678,171

(22) Filed: Feb. 23, 2007

(65) Prior Publication Data

US 2008/0202376 A1 Aug. 28, 2008

(51) Int. Cl.
*B61C 17/00* (2006.01)

(52) U.S. Cl. ..... 105/26.05

(58) Field of Classification Search ..... 105/26.05, 105/27, 35, 49, 62.1, 73, 76
See application file for complete search history.

(56) References Cited

U.S. PATENT DOCUMENTS

| | | | | |
|---|---|---|---|---|
| 6,279,550 | B1 * | 8/2001 | Bryant | 123/559.1 |
| 6,552,439 | B2 * | 4/2003 | Dunsworth et al. | 290/41 |
| 6,725,134 | B2 * | 4/2004 | Dillen et al. | 701/19 |
| 7,055,504 | B1 * | 6/2006 | Gallagher et al. | 123/501 |

* cited by examiner

*Primary Examiner* — S. Joseph Morano
*Assistant Examiner* — R. J. McCarry, Jr.
(74) *Attorney, Agent, or Firm* — GE Global Patent Operation; John A. Kramer

(57) ABSTRACT

A railroad locomotive includes a naturally aspirated reciprocating internal combustion engine driving a traction generator. A speed control system and load regulator provide an output signal which is operated upon and modified by a controller in response to the barometric pressure at which the locomotive is being operated.

21 Claims, 4 Drawing Sheets

ALTITUDE COMPENSATION SYSTEM FOR NATURALLY ASPIRATED RAILROAD LOCOMOTIVE

BACKGROUND OF THE INVENTION

1. Field of the Invention

The present invention relates to a system for controlling the air/fuel ratio and output of a naturally aspirated railroad locomotive in response to operation at barometric pressures characteristic of operation at varying altitudes. The present invention allows the smoke output of the locomotive to be controlled at changing altitudes.

2. Disclosure Information

Naturally aspirated railroad locomotives typically are powered by compression ignition "diesel" engines. Such engines may be either four-stroke cycle or two-stroke cycle engines. Four-stroke naturally aspirated engines have no charge air booster such as a turbocharger or a supercharger. Two-stroke cycle diesel engines used in railroad locomotives are typically scavenged with a positive displacement blower such as a Roots-type blower. Notwithstanding the use of blower scavenging, such engines typically operate in a manner similar to naturally aspirated engines because the Roots blower or other type of positive displacement blower merely serves to force exhaust gases from the engine's cylinders at a pressure only slightly above atmospheric pressure, with the result that the airbox supplying the engine cylinders or intake manifold operates very closely to ambient air pressure.

Naturally aspirated railroad locomotives are, of course, subject to operation at altitude, and at higher altitudes, say above 2500 feet, operation may be characterized by production of excessive exhaust smoke. This smoke results from the lack of oxygen at higher altitudes. Naturally aspirated locomotives are usually calibrated so that the engine powering the locomotive operates at one of eight notches characteristic of different engine speeds. Moreover, each notch is usually calibrated at a different air/fuel ratio, with notch 1, the lowest engine speed having the leanest air/fuel ratio or highest numerical air/fuel ratio, and notch 8 having the richest, or lowest numerical air/fuel ratio. It is easily seen that if a naturally aspirated locomotive is operated at high altitude at the higher notches, e.g., 6, 7 and 8, smoking may occur due to the richer fuel calibration at the higher notches, coupled with lack of oxygen availability.

It would be desirable to control air/fuel ratio with the engine operating system commonly used on naturally aspirated locomotives, so as to reduce the production of smoke when the engine is operated at higher altitudes.

SUMMARY OF THE INVENTION

According to an aspect of the present invention, a railroad locomotive includes a naturally aspirated reciprocating internal combustion engine and a traction generator driven by the engine. A speed control subsystem generates a speed signal corresponding to a predetermined engine operating speed selected by the locomotive's operator. The speed control system includes a throttle response circuit, a rate control module, and a wheel slip module. A load regulator receives the speed signal and outputs an excitation signal which is normally used to control the output of the traction generator. A controller receives the speed signal and the excitation signal, as well as the barometric pressure signal. The controller modifies the excitation signal in response to the value of the barometric pressure signal. A speed governor controls both the load regulator and a fuel supply system for the engine. The governor causes the amount of fuel being supplied to the engine to be reduced in the event that the engine load is decreased at constant throttle setting. In effect, the governor causes the amount of fuel being supplied to the engine to be reduced if the load upon the engine is reduced by the controller in response to decreasing barometric pressure, such that the air/fuel ratio is increased, and the production of smoke is thereby mitigated.

As noted above, the present invention is applicable to not only four-stroke cycle diesel engines but also blower-scavenged two-stroke cycle diesel engines.

According to another aspect of the present invention, the controller optionally receives an ambient air temperature signal and an ambient humidity signal in addition to the speed signal, excitation signal, and the barometric pressure signal. The controller also may receive a throttle position signal. The barometric pressure signal may correspond to either ambient air pressure, or to air pressure within an airbox located within the engine or other engine component. In either case, the barometric pressure signal corresponds to ambient barometric pressure. As noted below, other measures of air availability may be employed as a surrogate for barometric pressure according to the present invention.

According to another aspect of the present invention, the controller receives at least a speed signal, an excitation signal, and a barometric pressure signal, and modifies the excitation signal in response to predetermined changes in the value of at least the barometric pressure signal, such that the air/fuel ratio characterizing a particular combined engine speed-air/fuel ratio operating point will be modified. This is particularly useful for controlling emissions of a naturally aspirated reciprocating combustion engine having a number of discrete combined engine speed and air/fuel ratio operating points.

According to another aspect of the present invention, a method for controlling the air/fuel ratio of an naturally aspirated reciprocating internal combustion engine powering a traction generator in a railroad locomotive, in response to changing ambient conditions, includes operating the engine at one of a number of selected engine speed and air/fuel ratio operating points, and generating a signal related to barometric pressure. The method also includes modifying a traction motor excitation signal so as to reduce the output of the traction generator and therefore, the load upon the engine, at a selected engine speed, if the barometric pressure has decreased past a predetermined threshold. Finally, the method includes decreasing the fuel rate of the engine so that the engine's air/fuel ratio is increased while operating the engine at the selected speed and at said reduced load. The air/fuel ratio will generally be increased to a predetermined value. The method may also include modification of excitation to reduce the output of the traction generator and load upon the engine if ambient humidity exceeds a predetermined threshold.

According to another aspect of the present invention, a method for modifying the air/fuel ratio control of a naturally aspirated reciprocating internal combustion engine powering a traction generator in a railroad locomotive, so as to control smoke caused by varying air availability includes the steps of providing a single control module having an air availability sensing device, and providing the control module with a main generator excitation signal, followed by modifying the excitation signal in response to sensed air availability, and finally, transmitting the modified excitation signal to the traction generator.

It is an advantage of a method and system according to the present invention that excessive smoke emissions of a naturally aspirated railroad locomotive may be controlled without the need for costly aftertreatment devices.

It is yet another advantage of the present invention that smoke emissions may be controlled without the need for costly retrofitting of modified fuel injection hardware.

It is yet another advantage of a method and system according to the present invention that smoke emissions may be limited without causing duration while operating at low to moderate altitudes.

Other advantages, as well as features of the present invention, will become apparent to the reader of this specification.

DETAILED DESCRIPTION OF THE PREFERRED EMBODIMENTS

Figure 1:
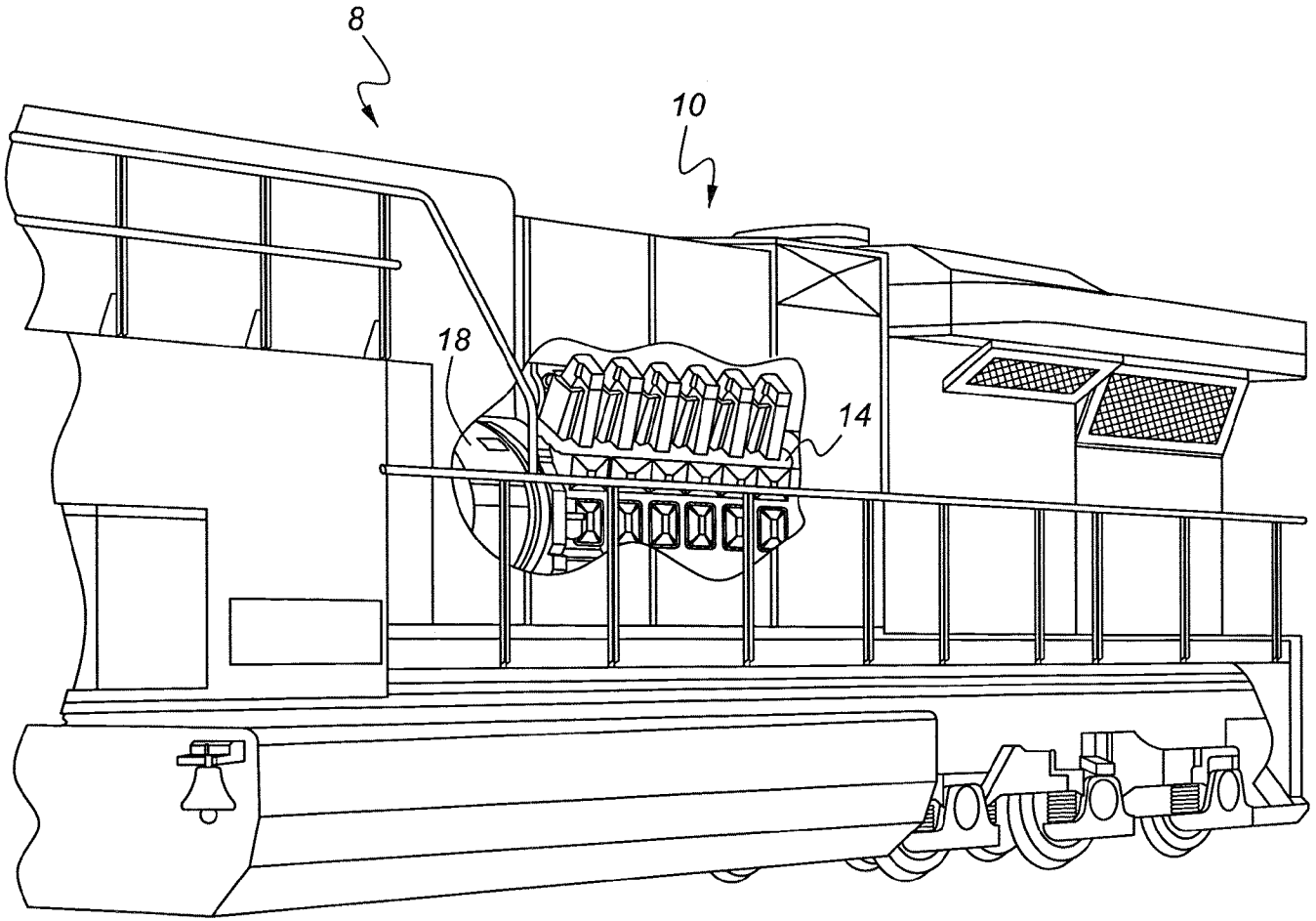
FIG. 1 is a perspective view of a railroad locomotive having an air/fuel ratio control system according to the present invention.

As shown in FIG. 1, railroad locomotive 10 has a naturally aspirated reciprocating internal combustion engine 14, which may comprise either a four-stroke cycle diesel engine, or a blower-scavenged two-stroke cycle diesel engine, or other type of reciprocating internal combustion engine suitable for use with the present invention. Thus, as used herein, the term "naturally aspirated" refers to either a four-stroke cycle engine without any type of charge air booster, or a two-stroke cycle engine using blower scavenging.

Engine 14 drives a traction alternator 18, which provides electrical power for operating locomotive 10.

Figure 2:
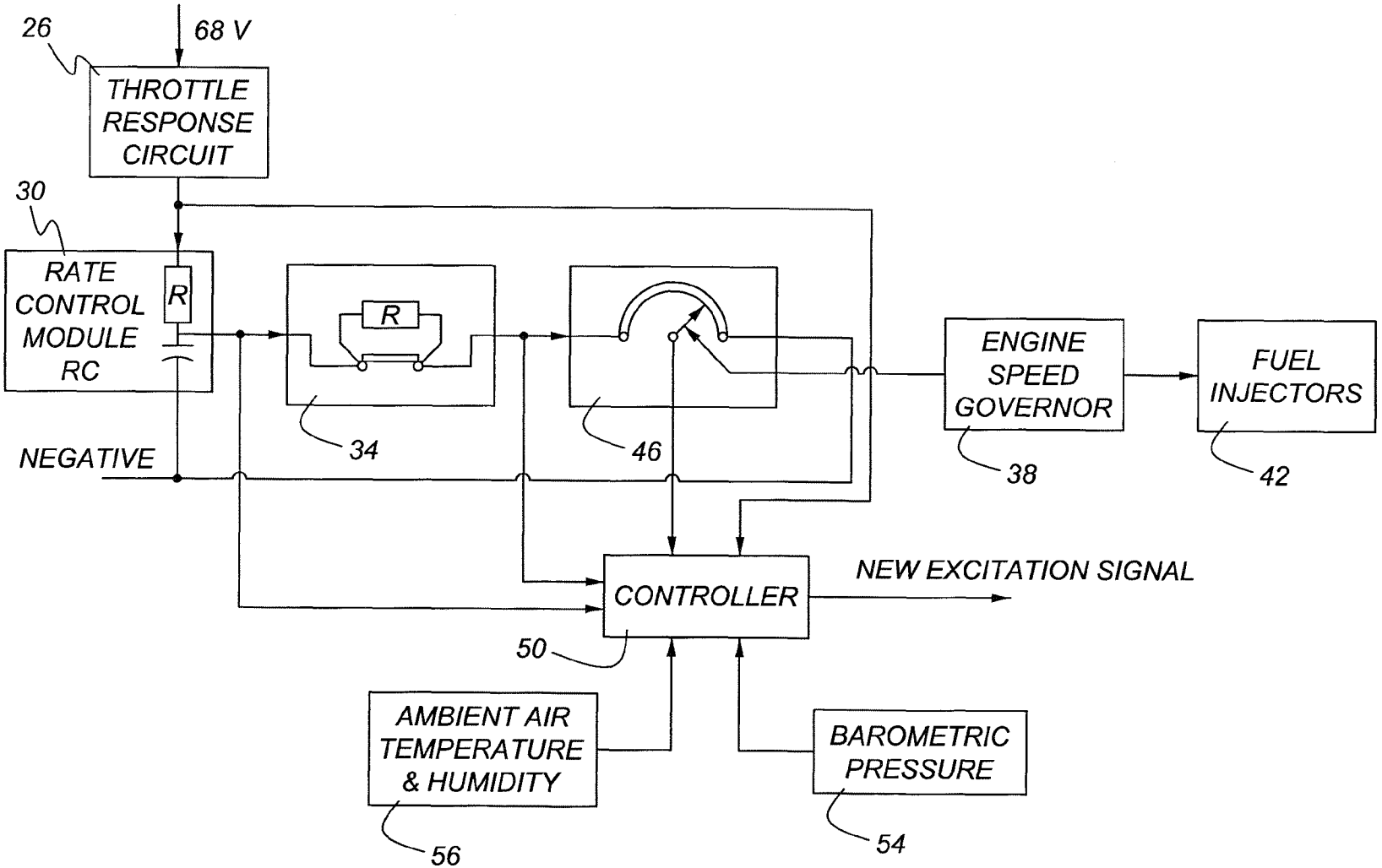
FIG. 2 is a schematic representation of a portion of a control system according to the present invention.

FIG. 2 illustrates a control system in which the operator of the locomotive positions a throttle, typically, at one of eight notches. The throttle position is picked up by throttle response circuit 26, which outputs a notch reference signal to a controller 50. Throttle response circuit 26 also feeds rate control module 30, which allows the output from throttle response circuit 26 to be ramped up and sent to wheel slip module 34. The purpose of wheel slip module 34 is to modify the output of rate control module 30 in the event that wheel slip is sensed. In general, throttle response circuit 26, rate control module 30, and wheel slip module 34 are components commonly used in known railroad locomotives.

The output of wheel slip module 34 is sent to controller 50, as a modified throttle or speed signal, and also sent to load regulator 46, which is controlled by engine speed governor 38. In essence, load regulator 46 is a potentiometer controlled by engine speed governor 38, which also controls fuel injectors 42 in response to engine speed. The output of load regulator 46 is an excitation signal which is sent to alternator 18. Controller 50 receives the output of load regulator 46 and modifies the excitation signal in response to at least the value of the barometric pressure signal from sensor 54. Controller 50 also may receive inputs from ambient air temperature and humidity sensors 56. Controller 50 may be constituted as either a microprocessor based controller, or an analog controller, or other type of controller known to those skilled in the art of machine and engine control and suggested by this disclosure. Controller 50 may also be configured as a standalone module with onboard barometric pressure measurement capability.

Figure 3:
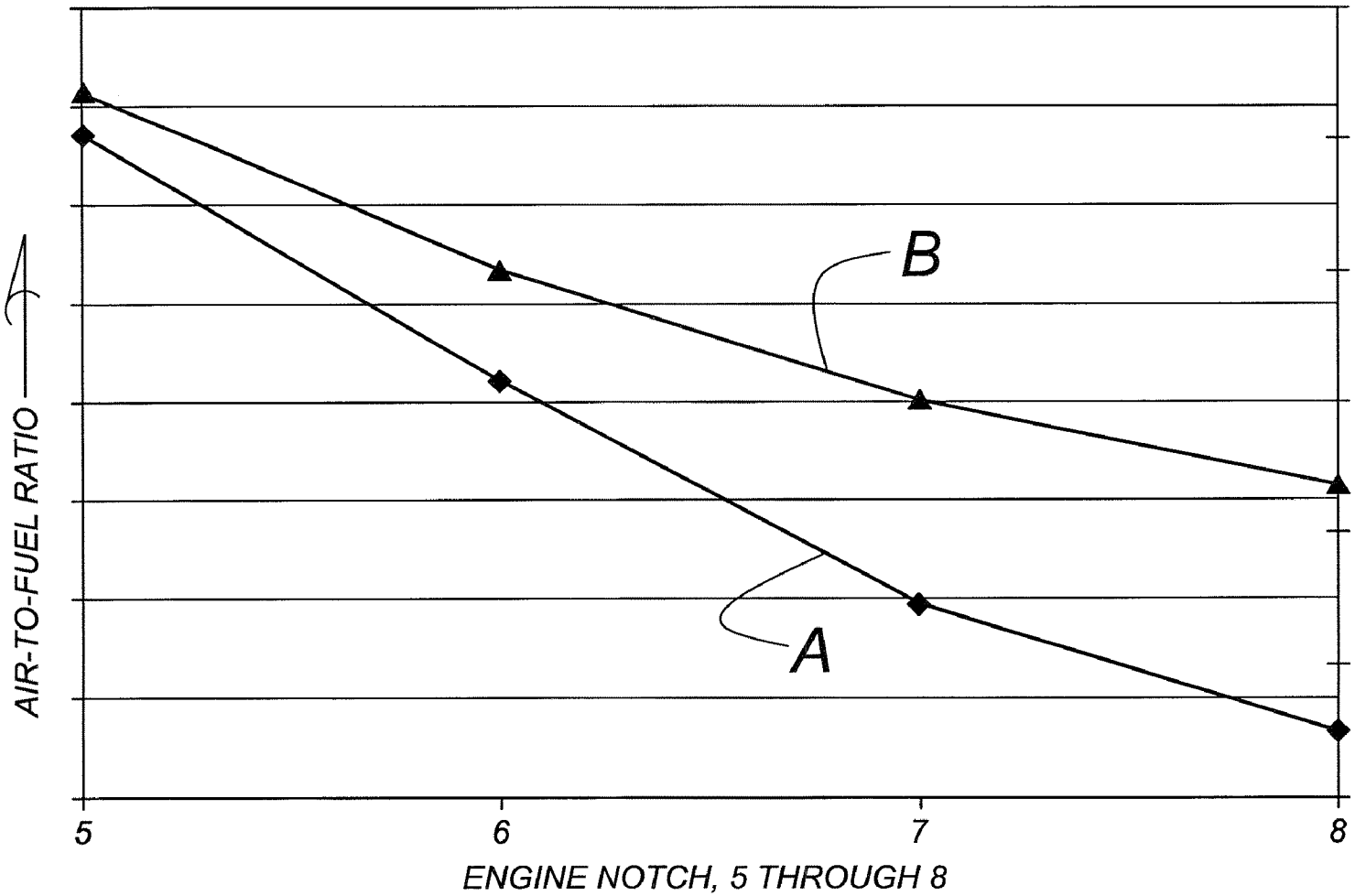
FIG. 3 is a plot showing discrete combined engine air/fuel ratio and speed operating points and adjusted operating points according to an aspect of the present invention.

As shown in FIG. 3, naturally aspirated railroad locomotives are typically operated at a variety of throttle notches, and for one particular locomotive, notches 5 through 8 are shown. Notice that each notch is characterized by different air/fuel ratio, with the most fuel rich ratio being at notch 8 and the most fuel lean ratio being at notch 5. This follows usual practice, because the highest engine speed and lowest practicable air/fuel ratio give the greatest power output. FIG. 3 also shows a plot of corrected air/fuel ratio following adjustment of the quantity of fuel being injected into the engine in response to the sensing of higher altitude operation. Thus, curve A of FIG. 3 depicts preset air/fuel ratio as a function of notch (engine speed), and B is modified air/fuel ratio produced by controller 50 in response to changes of barometric pressure. It is noted that plot B shows larger numerical air/fuel ratios, corresponding to leaner fuel lean operation, so as to control smoking.

Figure 4:
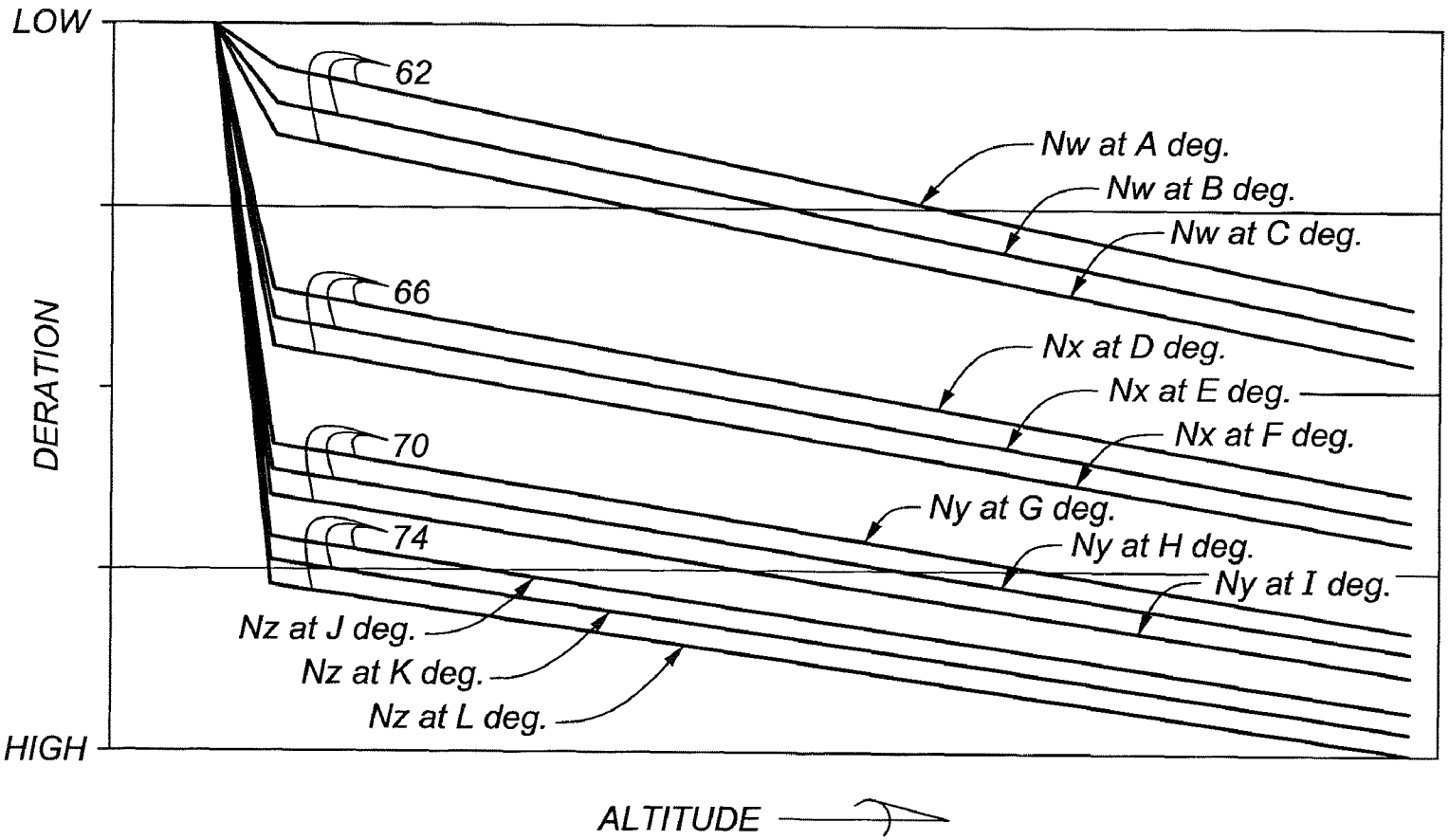
FIG. 4 is a family of curves showing air/fuel ratio control as a function of altitude according to an aspect of the present invention.

FIG. 4 illustrates families of curves, with each family of curves corresponding to a different operating notch of a locomotive. Curve 62 illustrates operation at a lower notch, which could be N5, and curves 74 illustrate operation at a higher notch, with curves 66 and 70 lying therebetween. Curves 70 could represent operation at N8.

For each family of curves in FIG. 4, operation is shown at three different temperatures A, B and C through J, K and L. The abscissa of FIG. 4 shows altitude increasing from left to right, while the ordinate illustrates duration resulting from the operation of controller 50 according to the present invention. In general, with curve 62, little duration is necessary, even as altitude increases. However, at the higher output levels or notches of engine 14, such as those illustrated by curves 66, 70 and 74, duration starts rapidly and increases with altitude and temperature. It should be noted that each family of curves, whether it be 62, 66, 70, or 74, represents operation at a unique engine speed which is characteristic of a particular notch.

According to another aspect of the present invention, a method for controlling the air/fuel ratio of naturally aspirated reciprocating internal combustion engine 14 powering traction generator 18, begins with operation of the engine at one of a plurality of the engine speeds shown, for example in FIG. 4. Barometric pressure is input to controller 50, and as altitude increases, or decreases, controller 50 modifies the excitation signal from load regulator 46 so as to increase or decrease the output of traction generator 18 and correspondingly, the load upon engine 14, all at a selected engine speed or notch position. When engine load is decreased by controller 50, the rotational speed of engine 14 will tend to increase, and in response, governor 38 will pull fuel from the engine, by reducing the amount of fuel provided by fuel injectors 42 to engine 14, and this will have the effect of increasing the numerical air/fuel ratio, because the engine will be operating at the same speed with a lesser amount of fuel. In turn, the higher numerical air/fuel ratio will limit the smoke output of the engine.

As noted above, a number of surrogates may be employed to substitute for an unvarnished barometric pressure signal. In essence barometric pressure is a measure of air or, more importantly, oxygen availability. In turn, air availability is a surrogate for oxygen availability. Air availability may be determined by a number of methods including: measuring pressure within an inlet manifold associated with said engine; by measuring pressure within a crankcase associated with the engine; by measuring output pressure of a cooling system blower located within the locomotive; by global position sensing and associated lookup of altitude; by measuring the temperature of the exhaust of the engine and ambient temperature; by measuring ambient oxygen concentration; by measuring of exhaust smoke opacity, or by means of a manually activated high-altitude switch.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A railroad locomotive, comprising:

a naturally-aspirated, reciprocating internal combustion engine;

a traction generator driven by said engine;

a speed control subsystem for generating a speed signal corresponding to an operational speed selected by the locomotive's operator;

a load regulator for receiving said speed signal and for outputting an excitation signal for said traction, generator; and a controller for receiving at least said speed signal, said excitation signal, and a barometric pressure signal, with said controller modifying said excitation signal in response to at least the value of said barometric pressure signal, wherein said controller receives an ambient air temperature signal, in addition to said speed signal, said excitation signal, and said barometric pressure signal.

2. A railroad locomotive according to claim 1, wherein said engine comprises a four-stroke cycle diesel engine.

3. A railroad locomotive according to claim 1, wherein said engine comprises a blower-scavenged, two-stroke cycle diesel engine.

4. A railroad locomotive according to claim 1, further comprising an engine speed governor for controlling both said load regulator and a fuel supply system for said engine, with said governor causing the amount of fuel being supplied to the engine to be reduced, while decreasing engine load at a constant engine speed, with the result that smoke emissions from the engine will be reduced.

5. A railroad locomotive according to claim 1, wherein said speed control subsystem comprises a throttle response circuit, a rate control module, and a wheel slip module.

6. A railroad locomotive according to claim 1, wherein said controller receives a throttle position signal in addition to said speed signal, said excitation signal, and said barometric pressure signal.

7. A railroad locomotive according to claim 1, wherein said barometric pressure signal corresponds to ambient barometric pressure.

8. A railroad locomotive according to claim 1, wherein said engine comprises a blower scavenged two-stroke cycle engine and said barometric pressure signal corresponds to air pressure within an airbox located within said engine.

9. A railroad locomotive, comprising:

a naturally-aspirated, reciprocating internal combustion engine;

a traction generator driven by said engine;

a speed control subsystem for generating a speed signal corresponding to an operational speed selected by the locomotive's operator;

a load regulator for receiving said speed signal and for outputting an excitation signal for said traction generator; and a controller for receiving at least said speed signal, said excitation signal, and a barometric pressure signal, with said controller modifying said excitation signal in response to at least the value of said barometric pressure signal, wherein said controller receives an ambient humidity signal, in addition to said speed signal, said excitation signal, and said barometric pressure signal.

10. A railroad locomotive according to claim 9, wherein said controller receives an ambient air temperature signal, in addition to said speed signal, said excitation signal, said ambient humidity signal, and said barometric pressure signal.

11. A railroad locomotive, comprising:

a naturally-aspirated, reciprocating internal combustion engine having a plurality of discrete combined engine speed and air/fuel ratio operating points;

a traction generator driven by said engine;

a speed control subsystem for generating a speed signal corresponding to an operational speed selected by the locomotive's operator;

a load regulator for receiving said speed signal and for outputting an excitation signal for said traction generator; and a controller for receiving at least said speed signal, said excitation signal, and a barometric pressure signal, with said controller modifying said excitation signal in response to predetermined changes in the value of at least said barometric pressure signal, wherein said controller receives an ambient air temperature signal, in addition to said speed signal, said excitation signal, and said barometric pressure signal.

12. A railroad locomotive according to claim 11, wherein said controller modifies said excitation signal to reduce load upon said engine when said barometric pressure signal decreases past a predetermined low pressure threshold.

13. A railroad locomotive according to claim 12, further comprising a speed governor for controlling both said load regulator and a fuel supply system for said engine, with said governor causing the amount of fuel being supplied to the engine to be reduced, at the selected operational speed, if the load upon the engine is reduced by said controller in response to decreasing barometric pressure, such that the engine's air/fuel ratio will be increased and smoke emissions of the engine will be decreased.

14. A method for controlling the smoke emissions and air/fuel ratio of a naturally aspirated reciprocating internal combustion engine powering a traction generator in a railroad locomotive, in response to changing ambient conditions, comprising:

operating the engine at one of a plurality of operator-selected engine speeds and corresponding air/fuel ratios;

generating a signal related to barometric pressure;

modifying an excitation signal, so as to reduce the output of said traction generator and the load upon the engine, at said selected engine speed, if said barometric pressure signal indicates that barometric pressure has decreased past a predetermined threshold; and decreasing the fuel rate of the engine so that the engine's air/fuel ratio is increased, while operating the engine at said selected engine speed and at said reduced load, whereby the output of smoke by said engine will be mitigated.

15. A method according to claim 14, wherein said air/fuel ratio is increased to a predetermined value.

16. A method according to claim 14, wherein said excitation signal is further modified so as to reduce the output of the traction generator and the load upon the engine if ambient temperature exceeds a predetermined threshold.

17. A method according to claim 14, wherein said excitation signal is further modified so as to reduce the output of the traction generator and the load upon the engine if ambient humidity exceeds a predetermined threshold.

18. A railroad locomotive according to claim 14, wherein said engine comprises a four-stroke cycle diesel engine.

19. A railroad locomotive according to claim 14, wherein said engine comprises a blower-scavenged, two-stroke cycle diesel engine.

20. A method for controlling the air/fuel ratio of a naturally aspirated reciprocating internal combustion engine powering a traction generator in a railroad locomotive, in response to changing ambient conditions, comprising:

operating the engine at one of a plurality of operator-selected engine speeds and corresponding air/fuel ratios, determining air availability;

modifying an excitation signal, so as to reduce the output of said traction generator, and the load upon the engine, at said selected engine speed, if air availability has decreased past a predetermined threshold; and decreasing the fuel rate of the engine so that the engine's air/fuel ratio is increased, while operating the engine at said selected engine speed and at said reduced load, whereby smoke production by the engine will be reduced.

21. A method for modifying the air/fuel ratio control of a naturally aspirated reciprocating internal combustion engine powering a traction generator in a railroad locomotive, so as to control smoke caused by varying air availability, comprising:

receiving, at a single control module having an air availability sensing device, a main generator excitation signal;

modifying the excitation signal in response to sensed air availability; and transmitting the modified excitation signal to the traction generator.

* * * * *